United States Patent [19]

Weber

[11] 4,336,674

[45] Jun. 29, 1982

[54] UNDERGROUND STRUCTURE FOR RESIDENTIAL AND BUSINESS USE

[76] Inventor: Raymond C. Weber, P.O. Box 108, Ligonier, Ind. 46767

[21] Appl. No.: 69,281

[22] Filed: Aug. 24, 1979

[51] Int. Cl.[3] ..... E04H 9/00; E02D 29/00

[52] U.S. Cl. ..... 52/169.6; 52/11; 52/86; 52/630

[58] Field of Search ..... 52/169.1–169.6, 52/86, 89, 11, 630

[56] References Cited

U.S. PATENT DOCUMENTS

| | | | |
|---|---|---|---|
| 3,482,406 | 12/1969 | Schuppisser et al. | 152/169.1 X |
| 3,922,823 | 12/1975 | King et al. | 52/169.3 |
| 4,078,346 | 3/1978 | Mann | 52/169.4 |
| 4,099,359 | 7/1978 | Sivachenko | 52/630 |
| 4,177,613 | 12/1979 | Czeiner | 52/86 |

FOREIGN PATENT DOCUMENTS

| | | | |
|---|---|---|---|
| 1264737 | 3/1968 | Fed. Rep. of Germany | 52/169.6 |
| 1548654 | 10/1968 | France | 52/169.6 |

OTHER PUBLICATIONS

American Builder, Apr. 1963, NA 1.A35, pp. 60 and 61.

*Primary Examiner*—J. Karl Bell

[57] ABSTRACT

An underground structure having at least one uncovered windowed wall, has side walls and roof constructed of corrugated sheet metal, the roof being constructed as a single or multi-arch in order to support the overlying earth, both the roof and base being drained of water which collects at the subsurface levels.

8 Claims, 12 Drawing Figures

UNDERGROUND STRUCTURE FOR RESIDENTIAL AND BUSINESS USE

BACKGROUND OF THE INVENTION

In order to conserve energy, home builders have looked increasingly to the inherent advantages of an underground dwelling because of the built-in insulation values of an underground home. The earth lends a tempering effect on ambient temperatures, providing warmth in the wintertime and coolness in the summertime. Such structures also offer further possibilities of protection from severely inclement weather. These advantages are inherent in the described construction.

A further advantage of underground homes and office buildings is that they are virtually maintenance-free exteriorly, and are protected against natural calamities, such as high wind, lightning, are tornado-proof, and are resistant to fire.

Another advantage of underground structures is that they are noise-suppressed. An underground structure is proof against almost all external noise except the most gross kinds, and as to these, there is a muffling, if not total exclusion.

Other advantages of underground homes are: there is virtually no possibility of frozen pipes and the resultant damage to plumbing and plumbing fixtures; insurance rates are markedly reduced because of the natural protection provided, and the cost of maintenance and heating are greatly minimized.

SUMMARY OF THE INVENTION

While superficially there has been some attempt at underground homes, in order to achieve the advantages which have been aforedescribed, there is nevertheless a reluctance to undertake such constructions because of concern that the building may collapse or deteriorate under the weight of the overlying earth.

Such concerns are justified if the materials of construction are inadequate to carry the weight of the surrounding earth material, or if the design is inherently defective.

In the present invention, it is a foremost object to provide readily accessible materials of construction in the form of corrugated sheet metal material to form the wall structure, and arched corrugated sheet metal for the roof structure, such arching being either formed as a single arch or multiple arches across the span separating the wall structures.

Either a single arch is provided, extending the entire width of the structure from the one remote wall to the other remote wall, or multiple arches are constructed extending from external walls to interior walls in order to encompass the entire overhead of the structure and on which earth is subsequently laid.

An important object of the present invention lies in the usage of drainage means, both at the base level and the roof level, so that subterranean water is quickly drained from the vicinity of the structure to prevent dampness or water damage to the exterior structure.

Another and further object of the present invention is to provide a submerged home in which as little as one external windowed wall is provided. In this manner, exterior air is available for circulation through the home, to dissipate any dampness and enable ready egress in the event of emergency.

An important feature of the present invention lies in the economy of construction in which corrugated sheet metal, which is quite strong in compression, can be utilized in arched form so that its inherent compressive strength is fully realized in adaptation to the roof structure.

The arch structure is either greater than 180° or can consist of less than 180° but extending in multiple arches between the external and internal walls. In this manner the overhead earth is readily supportable by the arched corrugated roof structure and the overhead earth can be laid to a preferred depth required to assure advantageous insulation for the interior of the house as well as shielding from inclement and destructive weather conditions and obtain sound-deadening effects.

Whatever additional layering is desired in the form of fibreglass, Visqueen or other plastic lamination are added, as desired.

Other objects and features of the present invention will become apparent from a consideration of the following description which proceeds with reference to the accompanying drawings.

DRAWINGS

Figure 3:
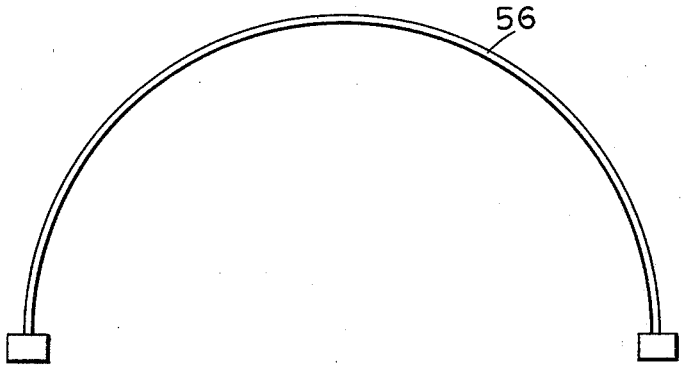
Figure 4:
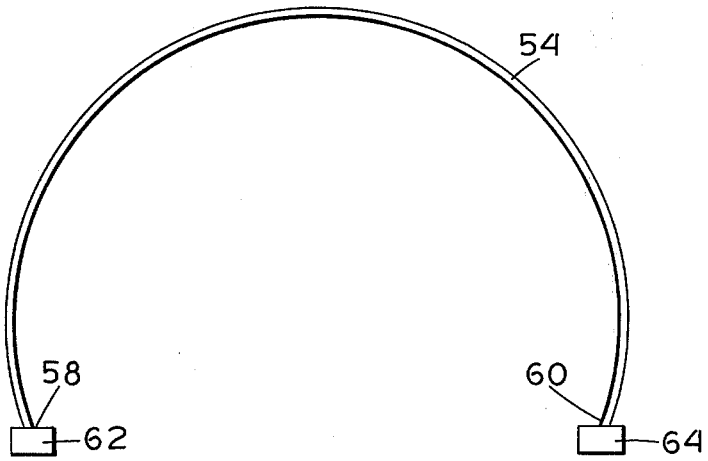

FIG. 3 illustrating the prior art; and,

FIG. 4 illustrating a further embodiment of the invention.

Figure 5:
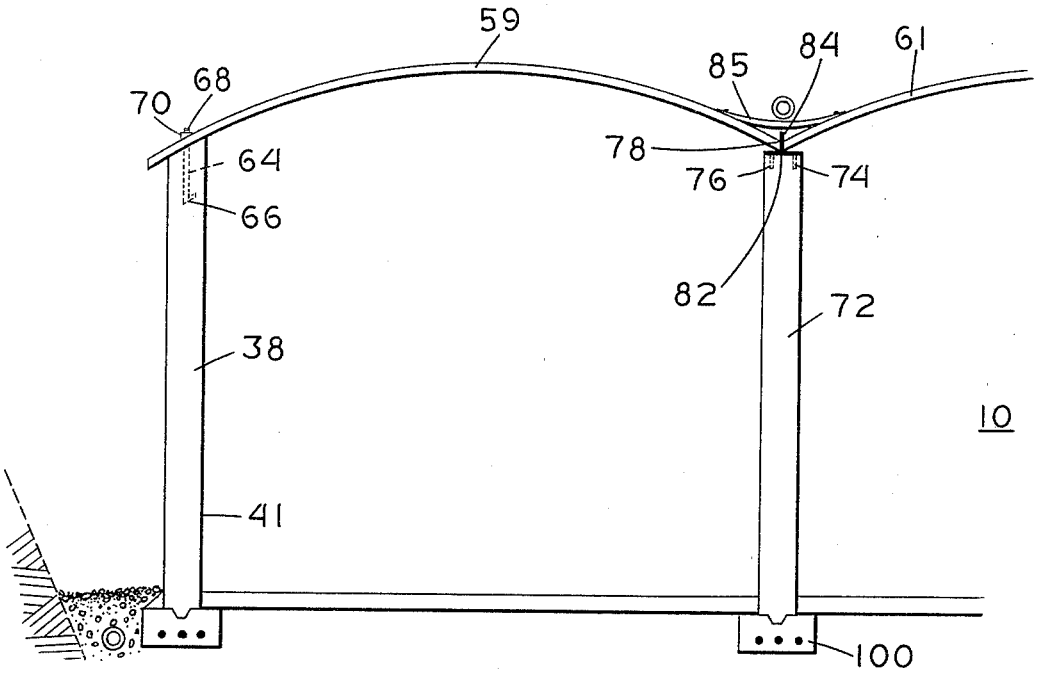
Figure 6:
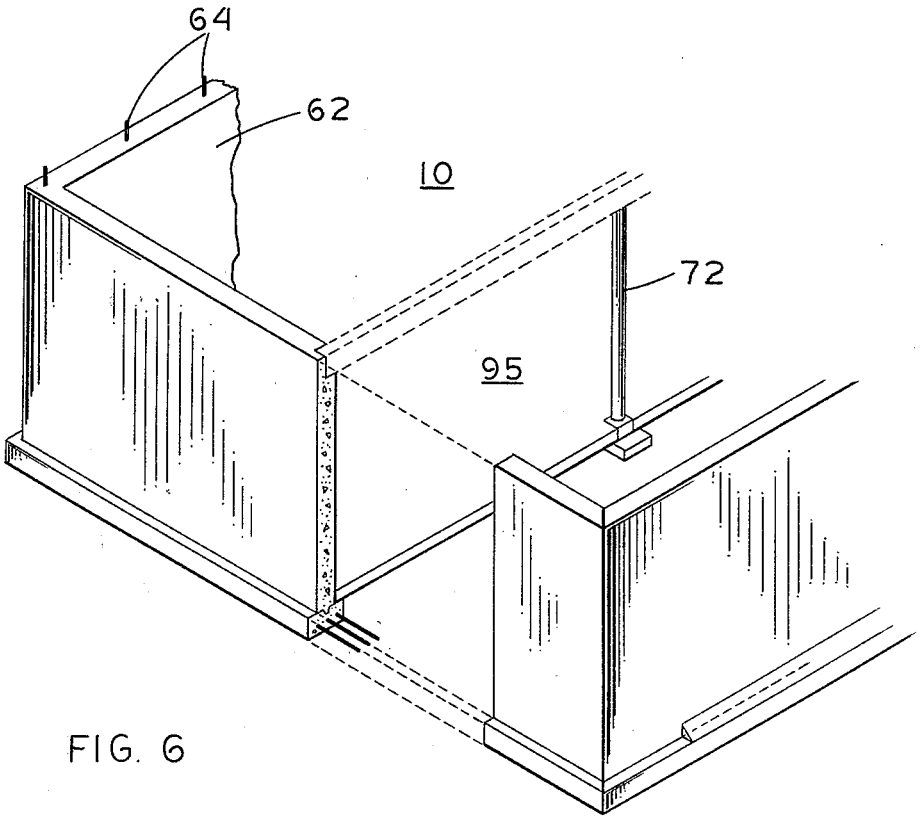
Figure 9:
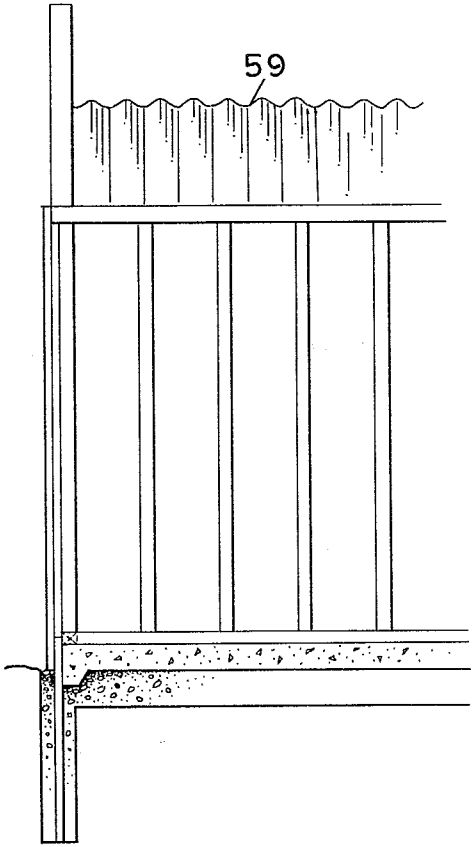
Figure 8:
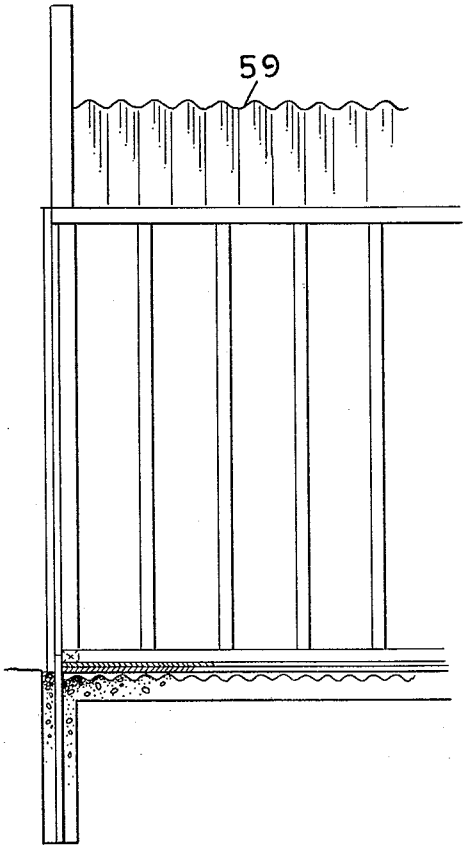
Figure 7:
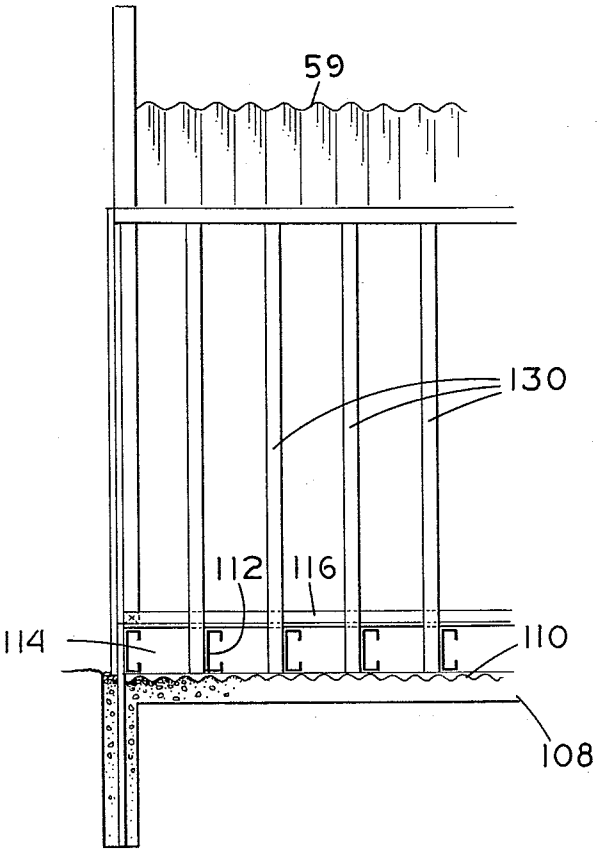
Figure 10:
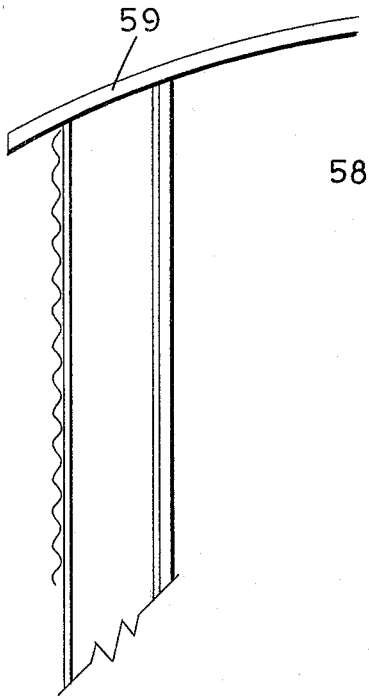
Figure 11:
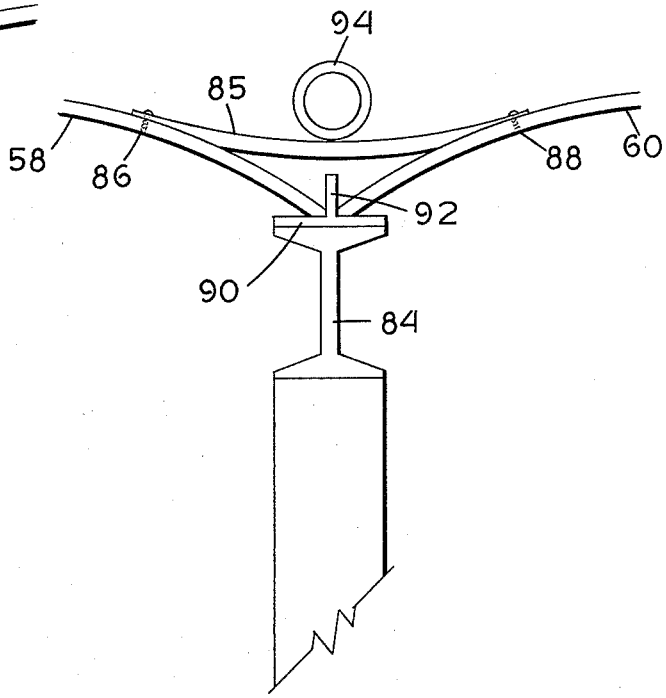
Figure 12:
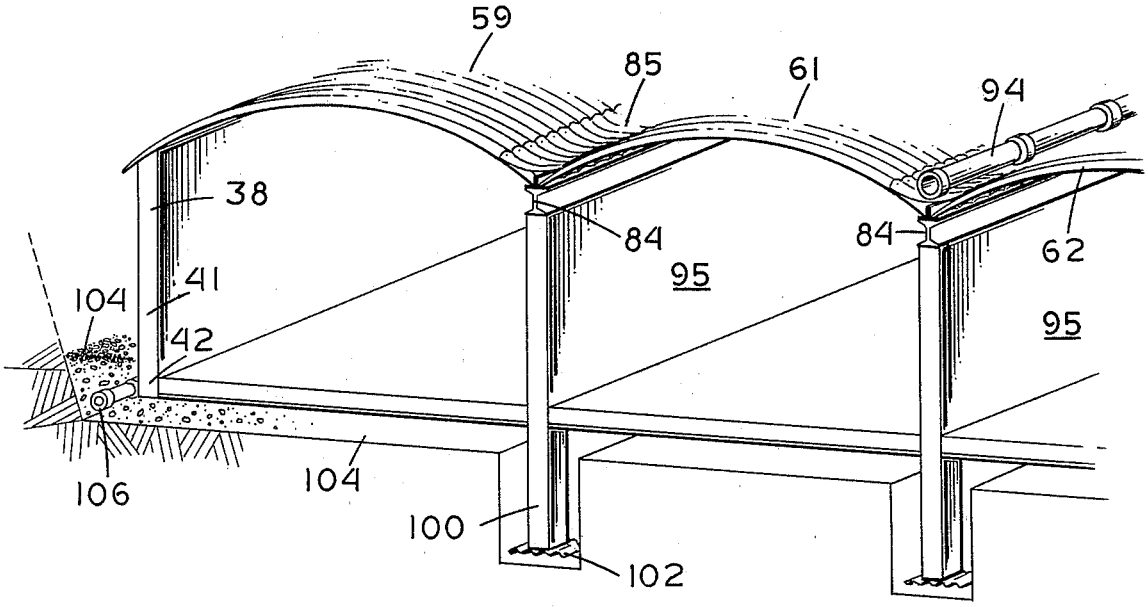

FIG. 5 is a sectional detail view illustrating, in a multi-arch construction, one of the arches in full view and extending from an external wall to an internal wall and a successive arch in fragmentary view extending from an internal wall to a succeeding adjacent wall;

FIG. 6 illustrates in detail view, partially in section, the method by which the roof load is carried from an intermediate load-bearing beam to an external rear wall structure;

FIGS. 7, 8, 9 are detail views of the base illustrating how the floor is supported on the base, either through beams, through a flat, metallic, intermediate support, or a second concrete poured section;

FIG. 10 is a detail fragmentary view of a corrugated wall and a part of the arched roof construction;

FIG. 11 is an enlarged, detail view of the load-bearing beam forming part of an internal wall and serving to provide support for each of adjacent intersection arches in a multi-arch construction; and, FIG. 12 is an isometric detail view illustrating two interior walls and one exterior wall of a multi-arched, earth-covered building and illustrating the footing and perimeter drain at the base and a partial view of the drain at the roof level.

DETAILED DESCRIPTION

Figure 1:
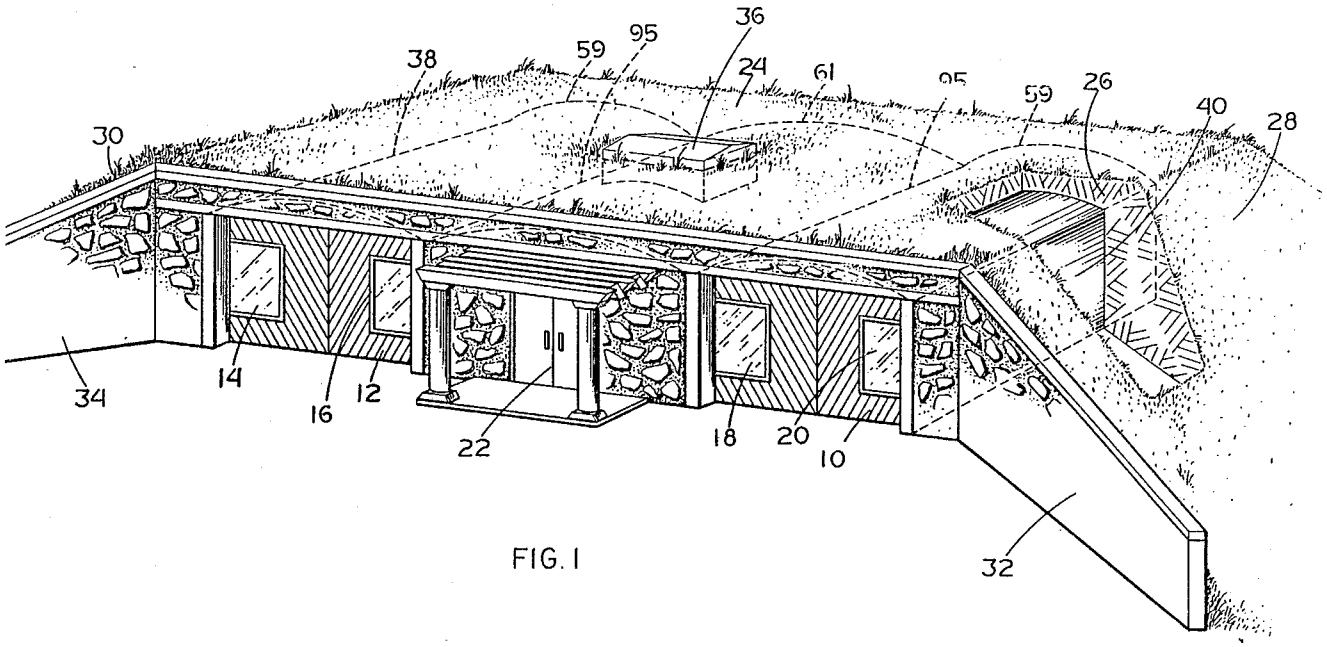
FIG. 1 is a perspective view illustrating the structure in the form of a home, and having one uncovered windowed wall, the remainder of the structure being totally earth-covered.

Referring to FIG. 1, a shelter designated generally by reference numeral 10, has an exposed wall 12 with windows 14, 16, 18, 20, and a doorway entrance 22. The purpose of this exposed wall is to provide both light and ventilation to the interior of the structure 10. The entire structure, other than the one exposed wall, is located below ground level 24, there being approximately 3 to 4 feet of sod 26 covering the overhead of the structure and tapering off into two inclined side mounds 28,30 which are buttressed by retaining walls 32,34 respectively.

A ventilation opening 36 opens above ground level to provide for further circulation of air and to maintain a turnover of interior atmosphere which circulates from the windows and doorway through the interior and is then vented to atmosphere.

Between the submerged structure and the sod 26 can be any number of protective layers constructed from Visqueen, plastic covering, metal shielding, etc., all of which are designed to shield the external roof and side wall structure and provide additional support for spreading the dead weight of the sod in as efficient a manner as possible.

Generally, the structure consists of two load-bearing sidewalls 38,40 (FIG. 2), which is made up of vertical columns 41 mounted on footings 42; between these columns is either a poured concrete sidewall or corrugated metal sheeting which is ribbed, or scalloped, to provide substantial bending resistance under the lateral load of the sod.

Figure 2:
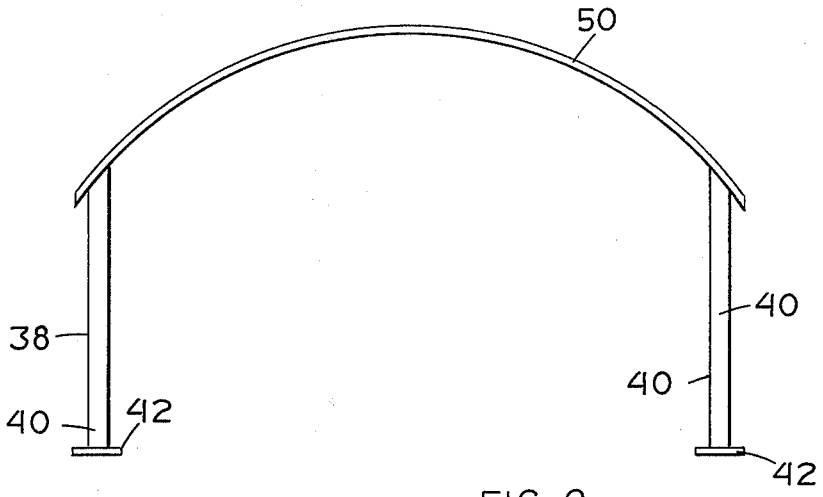
FIGS. 2, 3, 4 illustrate arch constructions with FIG. 2 illustrating an arch construction in accordance with the present invention.

At the overhead of the structure is an arched, sheet metal corrugated roof 50 which can be either arcuate as indicated in FIG. 2, or greater than 180° as indicated in FIG. 4 by reference numeral 54. The conventional arch as shown by reference numeral 56 in FIG. 3, is not included within the scope of the present invention.

It is possible to eliminate the sidewalls 38,40 if the arch 54 is extended in the manner illustrated in FIG. 4 with the ends 58,60 of the arch resting on pedestals 62,64.

In each instance, however, the roof is of corrugated sheet metal stock, curvilinear in cross section and arched, in order that it can better sustain the deadload of the overlying sod.

There can either be a single arch, as illustrated in FIGS. 2,4, or multi-arches, as represented by reference numerals 59,61 (FIG. 5), or 59,61,62 (FIG. 12). In any event, the arcuate or curvilinear cross section arches which are of corrugated sheet metal material, have appreciable bending resistance under the stress load of the overhead sod, rock, gravel, etc., and yet this building material is inexpensive and easy to provide.

In the event that a multi-arch construction is utilized as indicated in FIGS. 1, 12, the arches rest on one of the load support walls 38, 40, and at the other end on one of the internal walls. The arch is mechanically secured either directly to a column 41, or a set of beams, or poured concrete sidewall 62 (FIG. 6). Poured concrete sidewall 62 (in the event this is a poured concrete structure), includes a number of anchor bolts 64 which are embedded in the sidewalls and include a tip 66 to insure continued embedment. The projected upper end of each anchor bolt 68 is threaded to receive a nut 70 which holds the corrugated roof section 59 in place.

Referring to FIG. 5, intermediate wall 72 includes a column also with anchor bolts 74, embedded in the poured concrete columns (or steel columns, if preferred) and above the column is an Ibeam 78. Two arched corrugated roof sections 59,61 meet on flange 82 and bear against the web 84 of the beam 78 so that the two arches 59,61 are held in compression. To assist in holding the two arches 59,61 against movement, there is a shallow corrugated retainer 85 (FIGS. 11,12) which is fastened by screws 86,88 to roof sections 59,61 respectively, holding them against accidental movement away from the shim 90 and upright flange 92 which rests on the load-carrying beam 78.

A drain line 94 extends the length of the shelter, and rests on retainer 85 to insure that subsurface water is drained away from the vicinity of the structure.

Referring to FIGS. 10, 12, the sidewalls may not only be poured concrete, but can be corrugated sheet metal, as indicated in FIG. 10, or entirely poured concrete, as indicated in FIG. 12.

The interior walls 95 can each include a footing 100 (FIG. 12) which is excavated to a lower depth, and the footing 100 can include as indicated, sheet metal 102.

The base 104 is poured concrete, and includes trenching 104, with gravel, and drainage tile 106 to insure that rain or other moisture is carried away from the vicinity of the structure at the base portion thereof.

Referring next to the details illustrated in FIGS. 7, 8, and 9, the base 108 can be poured concrete with reinforcement 110 and a series of channels or beams 112 which create a dead air space 114 which can also be filled with insulation, to locate the floor 116 above the surface of base 108, thereby insuring better insulation and moisture-free floorline support.

As shown, the members 112 can be steel joists and a series of wood or steel studs 130 extend upwardly from the subflooring 116 and may consist of plywood or the like.

In another embodiment illustrated in FIG. 8, the steel joists can be omitted, and the subflooring rest directly on the base 108.

As illustrated in FIG. 9, the subflooring can consist of a concrete flooring which is finished poured concrete flooring located directly on the base and finished to grade.

In each of the floorings described, steel or wood studs can either extend from the base or subflooring, whichever is desired, and extends upwardly to provide the longitudinal beams which serve as the support for the arched overhead ceilings.

OPERATION

To construct the described residential or business building, the site is first graded, and excavated to the level of the base of the construction, and the walls 38,40 and roof 50 are constructed, either having a single span or multi-span corrugated arches 58,60 in the event the construction is in accordance with FIGS. 1, 5, 12, or single span in the case construction is in accordance with FIGS. 2, 4.

After the walls are constructed and the base is poured to the floor line, the subflooring is added by installing the cross steel joists or additional subconcrete flooring is poured. The arches are then set in place.

Plywood subflooring is also within the purview of the present invention.

The sidewalls, rear wall and ceiling are covered with protective Visqueen, gravel and the like, and sod is then added, with, typically, inclined sides 28,30 and rear (not shown), and the top of the structure is covered to grade with a sod covering which is seeded or turfed, as shown in FIG. 1.

A ventilation shaft 36 is added before the sodding, and extends above the ground level.

Once sodded, the underground home is fully insulated and ambient temperatures are tempered by the sublevel soil so that the interior is fully insulated, making it cooler in the summer and more temperate in the wintertime, thereby greatly conserving heating requirements for the interior of the structure. Typically, the soil is from 2 to 3 feet thick, the roof is designed to withstand in excess of 550 lbs. per sq.ft.

The interior is not damp, and has a natural insulating value which reduces heating and cooling costs to in the order of one-fourth the equivalent expenses for a surface home.

The structure is wind-proof, lightning, and tornado and fire resistant, has natural noise-freedom, and is virtually maintenance-free.

Although the present invention has been illustrated and described in connection with certain selected example embodiments, it will be understood that these are illustrative of the invention and are not restrictive thereof.

It is reasonably to be expected that those skilled in this art can make numerous revisions and adaptations of the invention and it is intended that such r-visions and adaptations will be included within the scope of the following claims as equivalents thereof.

What is claimed is:

1. A subsurface construction including at least one uncovered apertured wall, additional load-bearing walls located at a subsurface level and extending below ground surface to be surrounded by earth on at least two sides of said construction, an unstressed arched roof extending between two of the load-bearing walls and forming between the confronting arches a channel for directing water in each of opposite directions to drain water to a location beyond the outlines of the construction, an overhead layer of earth above the roof line to completely encompass the structure with an earthen layer on at least two sides of the structure, an inverted T-shaped means carried on an internal wall for bracing the roof structure between arch spans by opposing the tendency of the arched span ends to expand under the weight of the overhead earth and providing a common vertical support therefor, elongated pipe drainage means for conducting water away from the vicinity of the base of the structure and away from the roof structure, said roof structure being ribbed with corrugations extending throughout the entire length of the weight-supporting roof spans and being scalloped throughout the entire roof line thereof, said ribbed corrugations radiating from the horizontal axis of the roof structure and being in communication with said water drainage means to direct water from between the earth and the arched roof, and an arcuate cross section member extending across the intersection of the arch spans providing a support surface for said elongated pipe means and to shield the intersection against infiltration of water.

2. The dwelling construction in accordance with claim 1 including a plurality of arches extending across the front of the dwelling and including load-bearing vertical supports extending at the ends of the respective arches at spaced locations across the length and width of the structure.

3. The structure in accordance with claim 1 in which the arch is greater than 180° and the ends of the arch extend downwardly to be on vertical support members at floor level.

4. The dwelling structure in accordance with claim 1 in which the footings for the structure include drainage means below the floor level, and transverse load-bearing beams for supporting the flooring above said drainage level.

5. The structure in accordance with claim 1 wherein the floor level is defined by a poured base forming a continuous base support for the flooring interiorly of said structure.

6. The structure in accordance with claim 1 including a flooring having a plurality of spaced beams which suspend the flooring upwardly from the base level of the structure.

7. The structure in accordance with claim 1 wherein the wall and roof members are constructed of corrugated sheet metal stock.

8. The structure in accordance with claim 1 in which drainage means is disposed at the roof level at the location of the intersection of each arch between the opposite side walls of the structure.

* * * * *